US007219736B1

(12) United States Patent
Levy

(10) Patent No.: US 7,219,736 B1
(45) Date of Patent: May 22, 2007

(54) EXTERNALLY TESTABLE REDUNDANT CONNECTIONS FOR SUBSEA WELLS

(75) Inventor: David Levy, Broussard, LA (US)

(73) Assignee: Petrotechnologies, Inc., Lafayette, LA (US)

( * ) Notice: Subject to any disclaimer, the term of this patent is extended or adjusted under 35 U.S.C. 154(b) by 360 days.

(21) Appl. No.: 10/994,779

(22) Filed: Nov. 22, 2004

(51) Int. Cl.
*E21B 29/12* (2006.01)
*E21B 43/017* (2006.01)

(52) U.S. Cl. ..... 166/336; 166/337; 166/250.01; 166/86.1

(58) Field of Classification Search ..... 166/368, 166/336, 337, 86.1, 82.1, 341, 339, 344, 166/378, 250.01, 250.08
See application file for complete search history.

(56) References Cited

U.S. PATENT DOCUMENTS 4,457,489 A * 7/1984 Gilmore ..... 251/148
4,693,315 A * 9/1987 Taylor ..... 166/336
4,877,089 A * 10/1989 Burns ..... 166/377
5,082,060 A * 1/1992 Johnson et al. ..... 166/339
5,864,057 A * 1/1999 Baird ..... 73/152.38
6,148,664 A * 11/2000 Baird ..... 73/152.38
6,186,229 B1 * 2/2001 Martin et al. ..... 166/250.08
6,561,278 B2 * 5/2003 Restarick et al. ..... 166/378
2002/0162667 A1 * 11/2002 Ingram et al. ..... 166/387

* cited by examiner

*Primary Examiner*—Thomas A Beach
(74) *Attorney, Agent, or Firm*—Buskop Law Group, PC; Wendy Buskop

(57) ABSTRACT

An externally testable redundant connection for a subsea well includes a tube, a connector assembly, and collar. The connector assembly includes a jam nut over the tube; a ferrule over the tube adjacent the jam nut; and a double jam nut disposed over the tube adjacent to the ferrule. The double jam nut includes a test port adapted to receive a test fluid through the test port for determining if the primary seal and the secondary seal are providing a leak proof sealing engagement. The collar engage the tube and transfers an axial force from the double jam nut and compresses the tube into a female profile forming a primary seal. A secondary seal is formed from a compression of the ferrule into the double jam nut using the jam nut.

28 Claims, 5 Drawing Sheets

Inset B

EXTERNALLY TESTABLE REDUNDANT CONNECTIONS FOR SUBSEA WELLS

FIELD

The present embodiments relate generally to testable connections. The present embodiments relate specifically to externally testable redundant connections for subsea wells.

BACKGROUND

The oil and gas industry utilizes a procedure known as "snubbing" in which a string of pipe is forced into a wellhole under pressure for various reasons, such as, to remove an obstruction that might exist in the well. In such cases, the wellhole usually has been drilled and a certain amount of casing has been set and blowout preventors or other ram apparatus have been installed at the wellhead to seal around the drill pipe or other pipe strings being inserted into the wellhole. These blowout preventers and ram-type apparatus seal around the string of pipe being snubbed into the well under pressure to prevent the pressurized fluid from escaping around the outside of the string of pipe.

In practice, the body of the individual segments of pipe comprising the string of pipe to be snubbed into the well usually are rack-tested hydrostatically or otherwise prior to use to make certain there are no leaks in the body of the pipe. However, as the connections between the various pipe segments are made-up and snubbed into the well, the connections are usually immediately subjected to high external pressures. The rack testing of the pipe segments will not reveal a leak that exists in a connection between two of the pipe segments. A leak in a connection creates a very hazardous working condition for all personnel involved as high-pressure fluid may flow from the inside of the wellhole, through the leak, upwardly through the string of pipe being snubbed into the well, and out onto the workmen. In addition, if corrective measures are required to correct the leak in a connection between the pipe segments after the string of pipe has been snubbed into the well, such corrective measures are expensive.

The oil and gas industry utilizes a procedure known as the work-over of a well in which a string of pipe is forced into a previously drilled well. The well is "live," that is, contains fluid under pressure, below a certain depth but because of some obstruction, such as sand or concrete or the like, contains little or no pressurized fluid above that depth. When the tool on the end of the string of pipe breaks through the obstruction, the entire drill string, including the connections between the segments, is subject to the pressures of the well, which pressures can be intense. The same problems described above with respect to snubbing pipe into a completely live well, are applicable to this workover procedure.

A need exists for testable redundant connections for subsea wells that can sustain very high pressures. A need exists for testable redundant connections that can be safely tested in the field at very high pressures prior to use to ensure a good fluid tight connection The present embodiments meet these needs.

BRIEF DESCRIPTION OF THE DRAWINGS

The present embodiments will be explained in greater detail with reference to the appended Figures, in which.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments herein and it can be practiced or carried out in various ways.

The present embodiments relate to connections, typically used for subsea wells. The connections are externally testable. The embodied connections utilize two seals to ensure environmental compliance and leak tight sealing.

In the embodied connections, the ferrule is crimped the tube to prohibit the rotation of the double jam nut, thereby preventing the double jam nut from vibrating loose from the tube.

Further, since the test port has a small diameter, the connection can sustain very high pressures and can be tested at very high pressures in the field prior to use to ensure a good fluid tight connection.

The embodied connections are easy to create and simple to install. The embodied connections are fast to manufacture and have high reliability due to the limited number of moving parts.

The connections can be used to isolate easily any leaks in a fluid system. Fluid comes out around the jam nut, comes out around the o ring, or goes into the tube for ease of detection during testing.

The double jam nut in the embodied connections is locking and cannot be unscrewed because of the ferrule. The ability to lock the double jam nut ensures that the jam nut does not vibrate loose during drilling or production. Further, the jam nut can be unscrewed and moved down the assembly without affecting the connection on the tube An embodiment of an externally testable redundant connection for a subsea well includes a tube, connector assembly, a collar, and a secondary seal. The connector assembly includes a jam nut disposed over the tube; a ferrule disposed over the tube adjacent the jam nut; and a double jam nut. The double jam nut includes a test port and a double jam nut seal. The double jam nut is disposed over the tube adjacent to the ferrule. The test port is between the double jam nut seal and the ferrule.

The collar engages the tube and is used to transfer an axial force from the double jam nut. The collar compresses one end of the tube into a female profile, thereby forming a primary seal. The secondary seal is formed from a compression of the ferrule into the double jam nut using the jam nut. The secondary seal comprises a three contact points.

The externally testable redundant connection is adapted to receive a test fluid through the test port in order to determine if the primary seal and the secondary seal are providing a leak proof sealing engagement.

Figure 1:
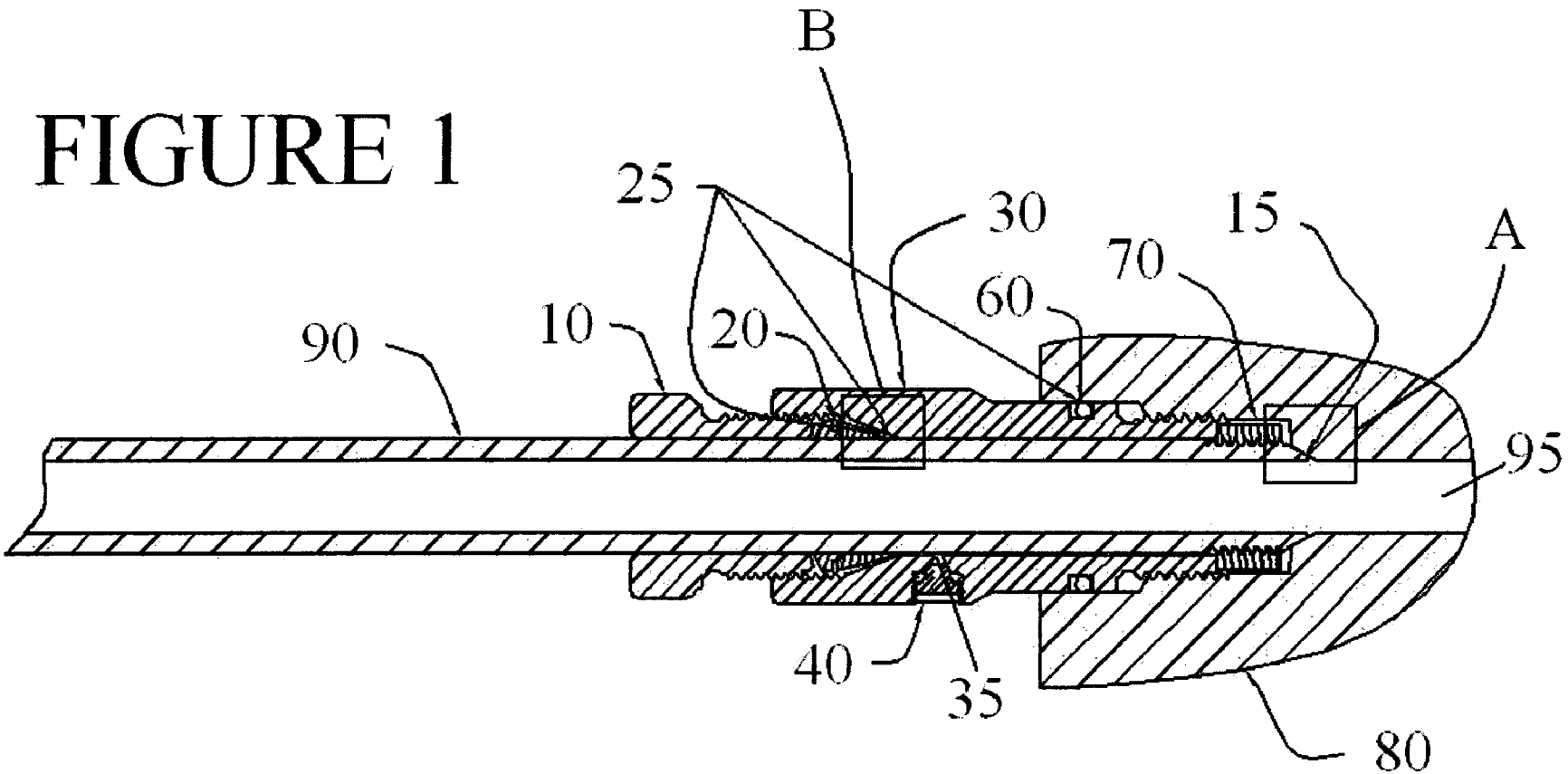
FIG. 1 is a cross sectional view of an embodiment of the externally testable redundant connection with a test port plug.
Figure 2:
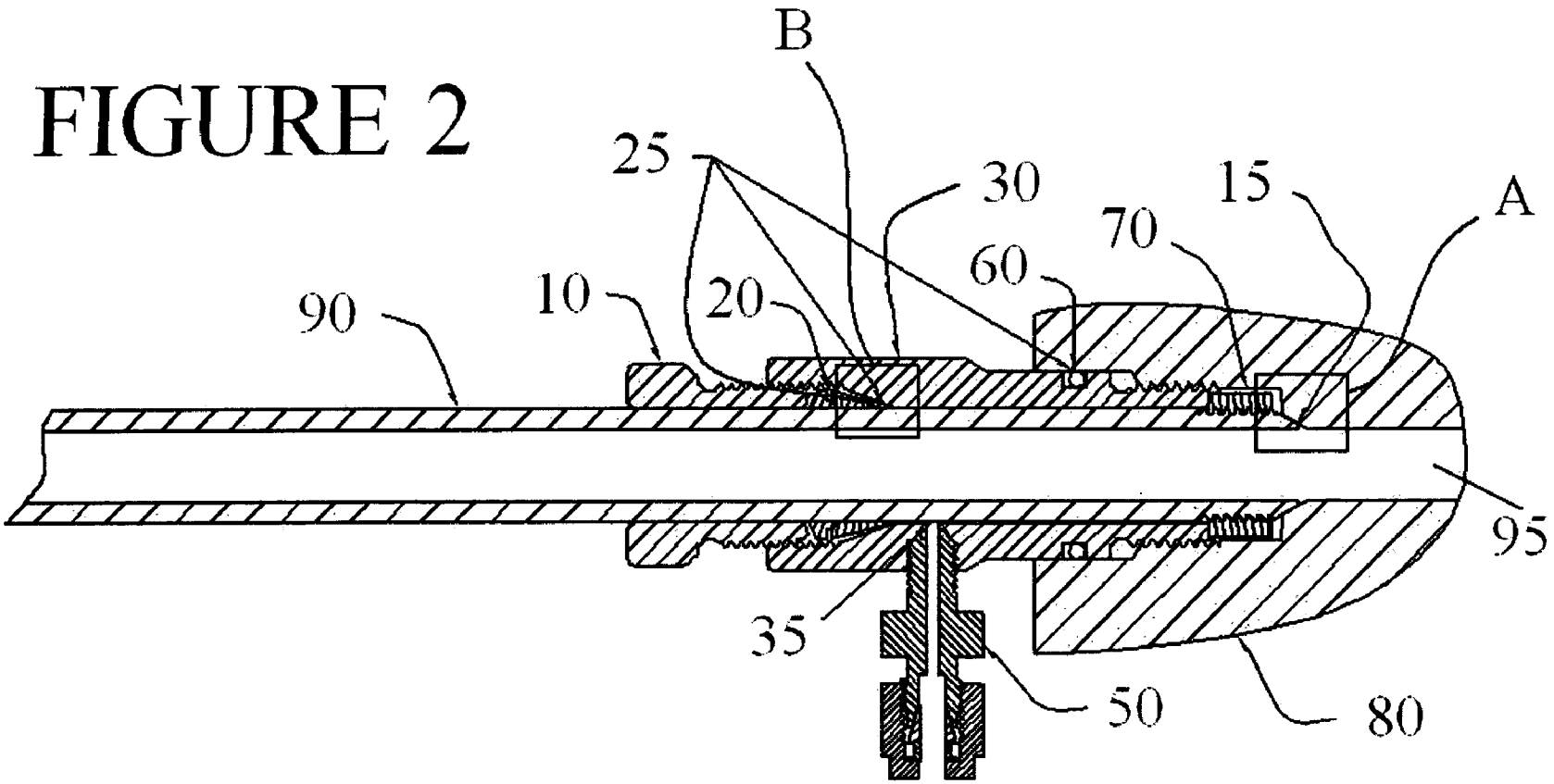
FIG. 2 is a cross sectional view of the embodiment of the externally testable redundant connection depicted in FIG. 1, wherein the test port plug has been replaced with a test connector.

With reference to the figures, FIG. 1 and FIG. 2 depict is a cross sectional view of an embodiment of the externally testable redundant connection.

The embodied connections include a tube (90). The tube (90) can be comprised of durable materials, such as steel alloy, carbon steel, steel, and combinations thereof. Typically, the tube (90) has an outer diameter ranging from about ⅛ inch to about 1 inch. The first end (95) of the tube (90) can be coned or threaded.

The connector assembly is attached to the first end (95) of the tube (90). The connector assembly includes a jam nut (10), a ferrule (20), and a double jam nut (30). A jam nut (10) is disposed over the tube (90) as depicted in FIG. 1 and FIG. 2. The jam nut (10) typically has an inner diameter ranging from about ⅛ inch to about 1 inch. The inner diameter provides a compressing engagement with the double jam nut (30). The compressing engagement is a threadable connection on the jam nut (10) adapted to engage a threadable connection of the double jam nut (30).

The ferrule (20) in the connector assembly is disposed over the tube (90) adjacent the jam nut (10). The ferrule (20) typically slidingly engages the double jam nut (30) and the female profile (80). An example of a ferrule (20) is a Swagelok™ or Parker™ model ferrules. The ferrule (20) can be adapted to crimp onto the tube (90) once the connector assembly is compressed by the jam nut (10).

The double jam nut (30) in the connector assembly has a test port (35) and a double jam nut seal (60). The double jam nut (30) is disposed over the tube (90) adjacent to the ferrule (20). The double jam nut seal (60) can be a locking double jam nut or an O-ring. FIG. 1 and FIG. 2 depict the embodiment wherein the double jam nut seal (60) is an O-ring. The double jam nut seal (60) can be formed by a second ferrule that seals against the double jam nut (30) and the female profile (80).

The test port (35) is between the double jam nut seal (60) and the ferrule (20). The test port (35) has an access hole with a diameter ranging from about 1/32 inch to about 1/16 inch. The test port (35) is typically a threadable engagement using metal to metal seals. The seals form a sealing engagement between a test fluid supply during seal testing and form a leak tight seal with a plug (40) when testing is complete. FIG. 1 depicts the embodiment wherein a plug (40) is inserted into the test port (35). Alternatively, a removable and re-installable test connector (50) can be inserted into the test port (35). FIG. 2 depicts the embodiment wherein a test connector (50) is inserted into the test port (35).

Continuing with FIG. 1 and FIG. 2, the connection includes a collar (70). The collar (70) is typically formed from a durable material, such as carbon steel, steel, or a high nickel alloy steel. The collar (70) can include left handed threads to ensure that during the installation of the double jam nut (30) the rotation of the double jam nut (30) tightens the collar (70). The collar (70) engages the tube (90) and transfers axial forces from the double jam nut (30). In addition, the collar (70) compress the first end (95) into a female profile (80) forming a primary seal (15).

Figure 3:
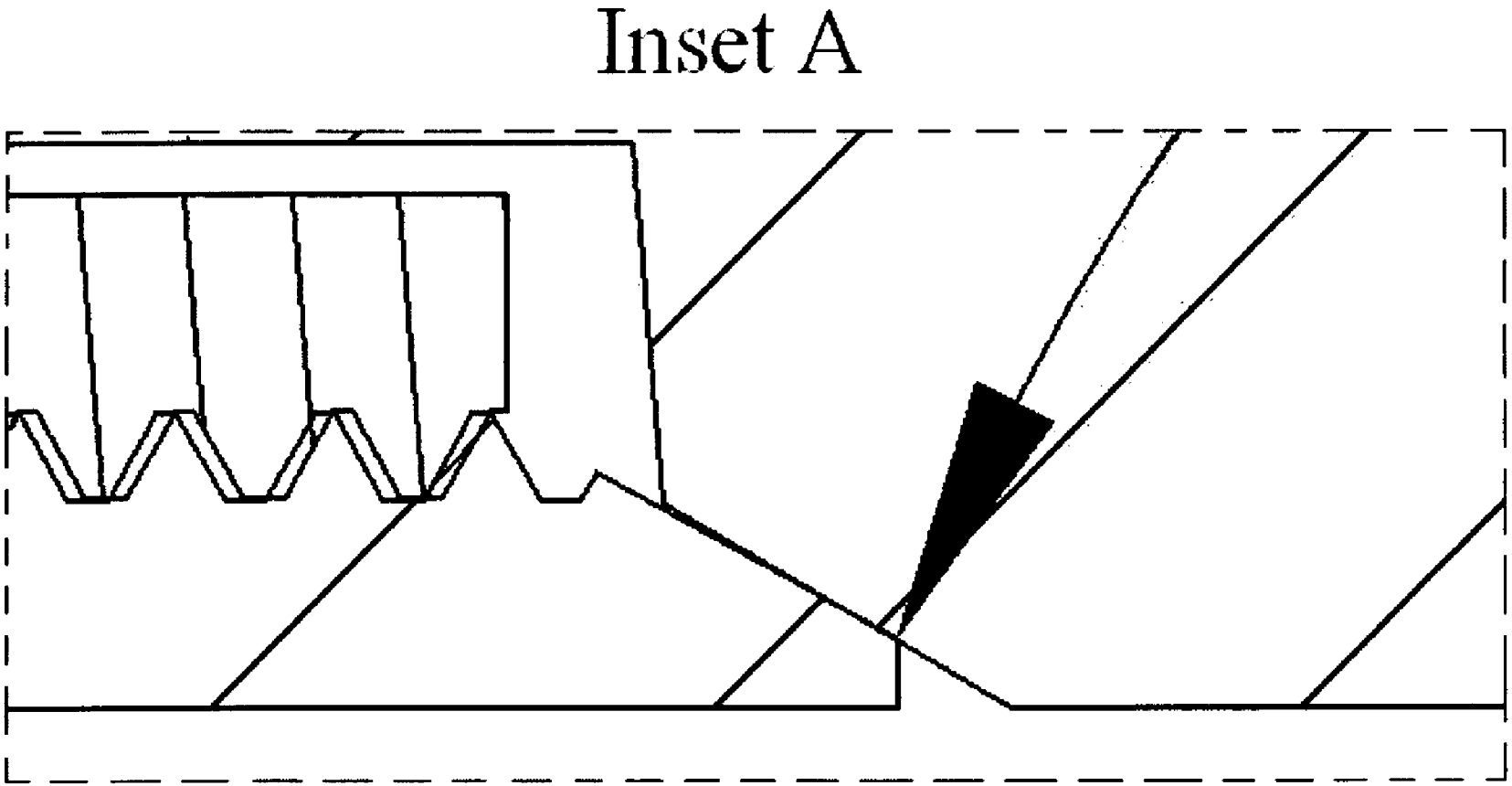
FIG. 3 is a detail of the inset "A" from FIG. 1 and FIG. 2 detailing the primary seal.

FIG. 3 is a detail of the primary seal (15) depicted in FIG. 1 and FIG. 2 as inset "A". The primary seal (15) is preferably a metal to metal seal. The primary seal (15) has a primary sealing surface between the first end (95) and the female profile (80). The primary seal (15) is formed by deforming the first end (95) into the female profile (80) by compressing the double jam nut (30) through the collar (70). The primary seal (15) can sustain pressure from about 5000 psi to about 40,000 psi, preferably from about 15,000 psi to about 25,000 psi.

Figure 4:
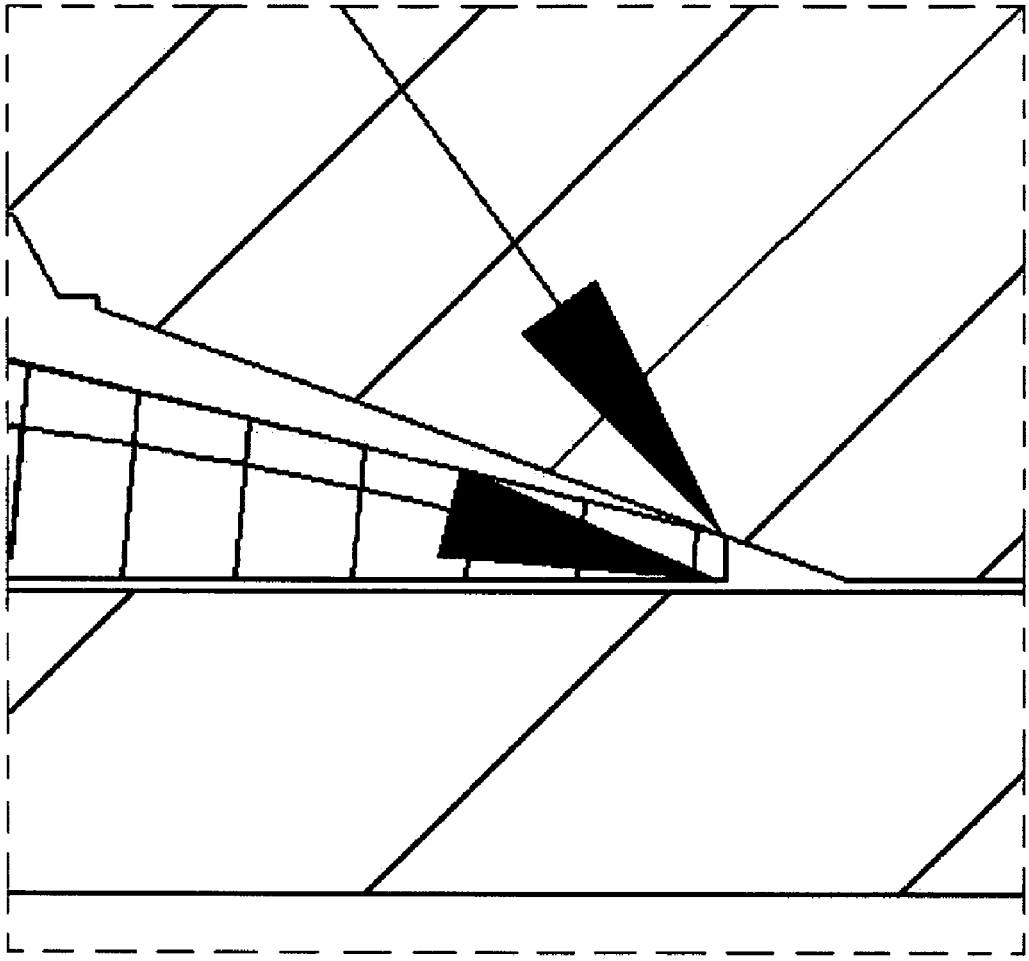
FIG. 4 is a detail of the inset "B" from FIG. 1 and FIG. 2 detailing the secondary seal.

FIG. 4 is a detail of the secondary seal (25) depicted in FIG. 1 and FIG. 2 as inset "B". The secondary seal (25) is formed by compressing the ferrule (20) into the double jam nut (30) using the jam nut (10). The secondary seal (25) has at least three contact points. The first contact point is between the double jam nut seal (60), the double jam nut (30), and the female profile (80). The second contact point is between the double jam nut (30) and the outer diameter of the ferrule (20). The third contact point is between the inner diameter of the ferrule (20) and the tube (90).

Similar to the primary seal (15), the secondary seal (25) is preferably a metal to metal seal. Alternatively, the secondary seal (25) can be an elastomeric seal. The secondary seal (25) can sustain pressure from about 5000 psi to about 40,000 psi.

Figure 5:
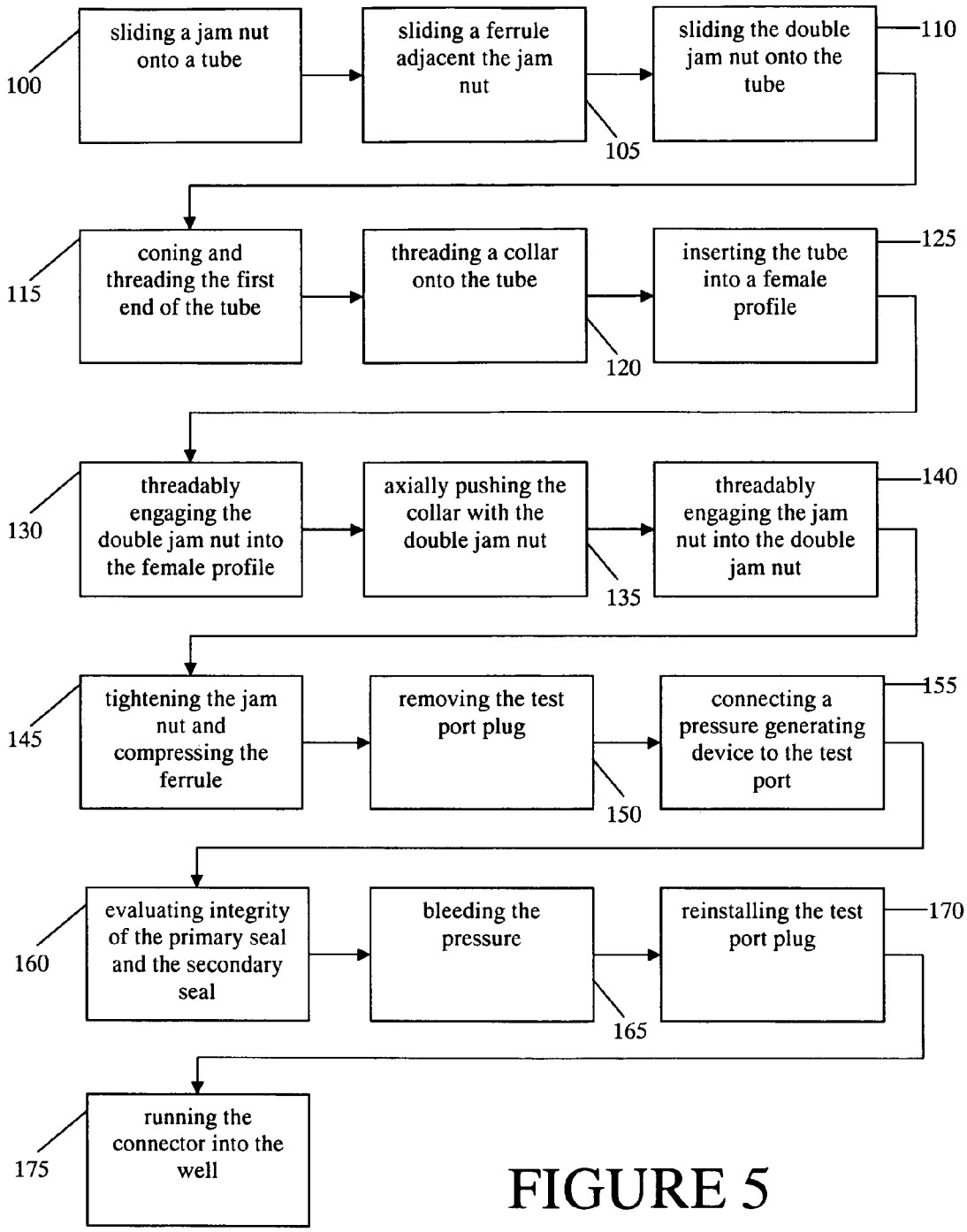
FIG. 5 is a schematic depicting an embodiment of a method of use for the externally testable redundant connection.

FIG. 5 is a schematic depicting an example of making the embodied externally testable redundant connections. The method of making the connection begins by sliding a jam nut onto a first end of a tube (Step 100); sliding a ferrule into the tube adjacent the jam nut (Step 105); and sliding the double jam nut onto the tube. As discussed, the double jam nut can include a test port and a double jam seal (Step 110).

An end of the tube is coned and threaded (Step 115). A collar is threaded onto the tube (Step 120) and the tube is inserted into a female profile (Step 125). The double jam nut is threaded into the female profile (Step 130), whereby the collar is pushed axially by the double jam nut to deform the cone of the tube into the female profile creating a primary seal (Step 135).

Continuing with the example depicted in FIG. 5, the method continues by threadably engaging the jam nut into the double jam nut while maintaining the ferrule between the jam nut and the double jam nut (Step 140). Next, the jam nut is tightened, the ferrule is compressed, and the ferrule is deformed into the double jam nut while deforming the ferrule into the tube creating a portion of a secondary seal (Step 145).

The test port plug is removed (Step 150) and a pressure generating device is connected to the test port (Step 155). The pressure generating device can be a test pump that uses a test fluid, such as a Haskell pump or Enerpac pump. Examples of usable test fluids include nitrogen, helium, another gas, water, and hydraulic fluid.

The method ends by evaluating integrity of the primary seal and the secondary seal (Step 160); bleeding the pressure (Step 165); reinstalling the test port plug (Step 170); and running the connector into the well (Step 175).

While these embodiments have been described with emphasis on the preferred embodiments, it should be understood that within the scope of the appended claims the embodiments might be practiced other than as specifically described herein.

What is claimed is:

1. An externally testable redundant connection for a subsea well comprising:

a. a tube comprising a first end;

b. a connector assembly comprising:

i. a jam nut disposed over the tube;

ii. a ferrule disposed over the tube adjacent the jam nut;

iii. a double jam nut comprising a test port and a double jam nut seal, wherein the double jam nut is disposed over the tube adjacent to the ferrule, and wherein the test port is between the double jam nut seal and the ferrule;

c. a collar for engaging the tube to transfer an axial force from the double jam nut and compress the first end into a female profile forming a primary seal;

d. a secondary seal formed from a compression of the ferrule into the double jam nut using the jam nut, wherein the secondary seal comprises a first contact point between the double jam nut seal, the double jam nut, and the female profile, wherein the secondary seal comprises a second contact point between the double jam nut and the outer diameter of the ferrule, and wherein the secondary seal comprises a third contact point between the inner diameter of the ferrule and the tube; and wherein the externally testable redundant connection is adapted to receive a test fluid through the test port for determining if the primary seal and the secondary seal are providing a leak proof sealing engagement.

2. The externally testable redundant connection of claim 1, wherein the tube comprises an outer diameter from about ⅛ inch to about 1 inch.

3. The externally testable redundant connection of claim 1, wherein the tube comprises steel alloy, carbon steel, steel, and combinations thereof.

4. The externally testable redundant connection of claim 1, wherein the first end of the tube is coned.

5. The externally testable redundant connection of claim 1, wherein the first end of the tube is threaded.

6. The externally testable redundant connection of claim 1, wherein the jam nut comprises an inner diameter from about ⅛ inch to about 1 inch, wherein the inner diameter provides a compressing engagement with the double jam nut.

7. The externally testable redundant connection of claim 6, wherein the compressing engagement is a threadable connection on the jam nut adapted to engage a threadable connection of the double jam nut.

8. The externally testable redundant connection of claim 1, wherein the ferrule slidingly engages the double jam nut and the female profile.

9. The externally testable redundant connection of claim 8, wherein the ferrule is adapted to crimp onto the tube once the connector assembly is compressed by the jam nut.

10. The externally testable redundant connection of claim 1, wherein the test port of the double jam nut is a threadable engagement using metal to metal seals to a. form a sealing engagement between a test fluid supply during seal testing; and b. form a leak tight seal with a plug when testing is complete.

11. The externally testable redundant connection of claim 10, wherein the test port comprises an access hole with a diameter from about 1/32 inch to about 1/16 inch.

12. The externally testable redundant connection of claim 1, wherein the test port further comprises a removable and re-installable test port plug.

13. The externally testable redundant connection of claim 1, wherein the double jam nut is a locking double jam nut.

14. The externally testable redundant connection of claim 1, wherein the double jam nut seal is an o-ring.

15. The externally testable redundant connection of claim 1, wherein the double jam nut seal is formed by a second ferrule that seals against the double jam nut and the female profile.

16. The externally testable redundant connection of claim 1, wherein the collar is carbon steel, steel, or a high nickel alloy steel.

17. The externally testable redundant connection of claim 1, wherein the collar comprises left handed threads to ensure that during installation of the double jam nut the rotation of the double jam nut tightens the collar.

18. The externally testable redundant connection of claim 1, wherein the primary seal is a metal to metal seal.

19. The externally testable redundant connection of claim 1, wherein the primary seal comprises a primary sealing surface between the first end and the female profile.

20. The externally testable redundant connection of claim 19, wherein the primary seal is formed by deforming the first end into the female profile due to the compression of the double jam nut through the collar.

21. The externally testable redundant connection of claim 20, wherein the primary seal sustains pressure from about 5000 psi to about 40,000 psi.

22. The externally testable redundant connection of claim 21, wherein the primary seal sustains pressure from about 15,000 psi to about 25,000 psi.

23. The externally testable redundant connection of claim 1, wherein the secondary seal is a metal to metal seal.

24. The externally testable redundant connection of claim 1, wherein the secondary seal is an elastomeric seal.

25. The externally testable redundant connection of claim 1, wherein the secondary seal sustains pressure from about 5000 psi to about 40,000 psi.

26. A method for making an externally testable redundant connection for a well, wherein the method comprises the steps of:

a. sliding a jam nut onto a first end of a tube;

b. sliding a ferrule into the tube adjacent the jam nut;

c. sliding the double jam nut onto the tube, wherein the double jam nut comprises a test port with a test port plug and a double jam seal;

d. coning and threading the first end of the tube;

e. threading a collar onto the tube;

f. inserting the tube into a female profile;

g. threadably engaging the double jam nut into the female profile;

h. axially pushing the collar with the double jam nut to deform the cone of the tube into the female profile creating a primary seal;

i. threadably engaging the jam nut into the double jam nut while maintaining the ferrule between the jam nut and the double jam nut;

j. tightening the jam nut, compressing the ferrule, and deforming the ferrule into the double jam nut while deforming the ferrule into the tube creating a portion of a secondary seal;

k. removing the test port plug;

l. connecting a pressure generating device to the test port;

m. evaluating integrity of the primary seal and the secondary seal;

n. bleeding the pressure;

o. reinstalling the test port plug; and p. running the connector into the well.

27. The method of claim 26, wherein the pressure generating device is a test pump uses gasses or fluids.

28. The method of claim 26, wherein the step of evaluating integrity of the primary seal and the secondary seal utilizes a test fluid selected from the group consisting of nitrogen, helium, another gas, water, and a hydraulic fluid.

* * * * *